US005571276A

United States Patent [19]

Kobos et al.

[11] Patent Number: 5,571,276

[45] Date of Patent: Nov. 5, 1996

[54] DISHWASHER FRONT PANEL RETAINER CHANNEL

[75] Inventors: Duane M. Kobos, Laporte, Ind.; Gary M. Lindgren, Three Oaks, Mich.; Joseph T. Ferencevich, Findlay, Ohio

[73] Assignee: Whirlpool Corporation, Benton Harbor, Mich.

[21] Appl. No.: 381,402

[22] Filed: Jan. 31, 1995

[51] Int. Cl.[6] ..... E06B 3/00; E04C 1/40; A47B 47/00

[52] U.S. Cl. ..... 312/265.6; 52/208; 312/265.5; 312/138.1; 312/109

[58] Field of Search ..... 52/204.7, 204.53, 52/204.62, 208, 716.8, 718.04, 718.06, 204.597, 204.591; 312/265.6, 265.5, 111, 109, 138.1, 236, 204

[56] References Cited

U.S. PATENT DOCUMENTS

| | | | |
|---|---|---|---|
| 3,294,461 | 12/1966 | Barnard et al. | 312/213 |
| 3,298,764 | 1/1967 | Goldfarb | 312/204 |
| 3,504,471 | 4/1970 | Aspaas | 52/204.597 |
| 3,744,201 | 7/1973 | Dochnahl | 52/204.597 |
| 3,936,107 | 2/1976 | Gourdeau et al. | 312/138.1 |
| 4,229,921 | 10/1980 | Schell | 312/204 X |
| 4,349,994 | 9/1982 | Maekawa | 52/204.597 X |
| 4,683,694 | 8/1987 | Ziegler | 52/204.597 X |
| 4,732,431 | 9/1988 | Mason | 312/109 |
| 4,949,520 | 8/1990 | Bear | 312/204 X |
| 4,950,019 | 8/1990 | Gross | 52/208 X |
| 5,114,206 | 5/1992 | Yada | 52/208 X |
| 5,396,746 | 3/1995 | Whitmer | 52/208 |
| 5,437,131 | 8/1995 | Tamura | 52/208 X |

*Primary Examiner*—Peter M. Cuomo
*Assistant Examiner*—Robert J. Sandy
*Attorney, Agent, or Firm*—Hill, Steadman & Simpson

[57] ABSTRACT

A channel member is provided which is configured to be held on the frame of an appliance. The frame includes a lip perpendicular to a first portion of the frame with a flange extending perpendicular to the lip parallel to and in the direction of the first portion of the frame. At least one tab projects out of the first portion of the frame. The channel member is configured to receive a retaining strip having a projecting portion. The channel member has a channel portion and a back portion. The back portion extends between the lip and the tab and has a portion retainingly held by the tab. The channel portion comprises a first resilient leg and a second resilient leg. The first and second legs are spaced apart to form a channel for receiving the projecting portion of the retaining strip. At least one of the first and second legs has a detent formed thereon to retainingly engage the projection. The second leg is configured to at least partially be received in an area defined by the first portion of the frame, the lip and the flange and yet to avoid engaging interference with the flange.

13 Claims, 2 Drawing Sheets

FIG. 3
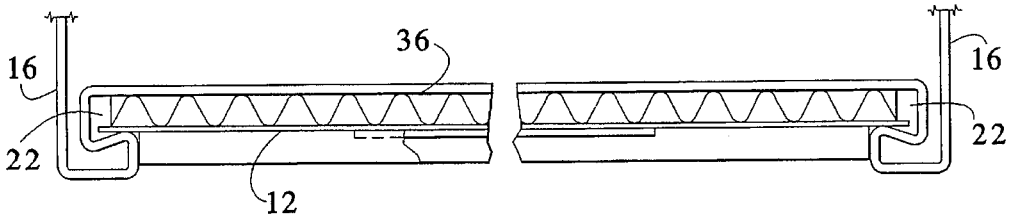
FIG. 4
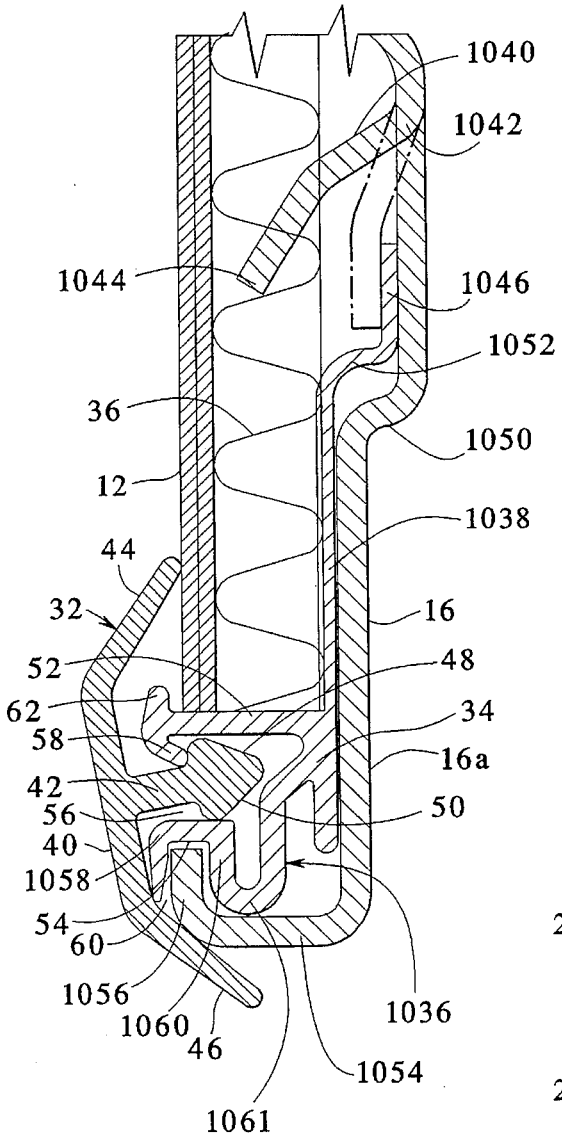
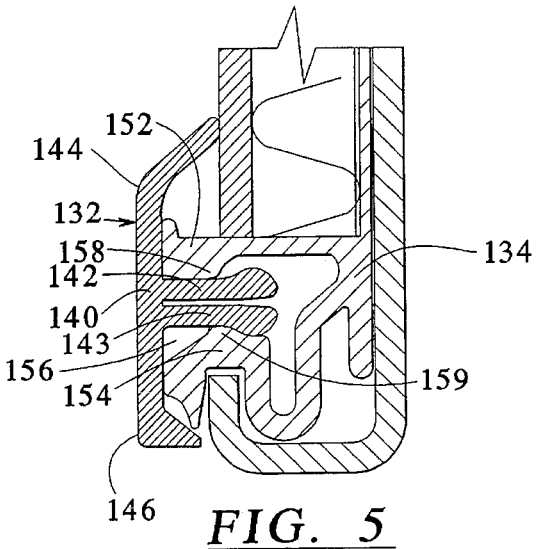
FIG. 5
FIG. 6
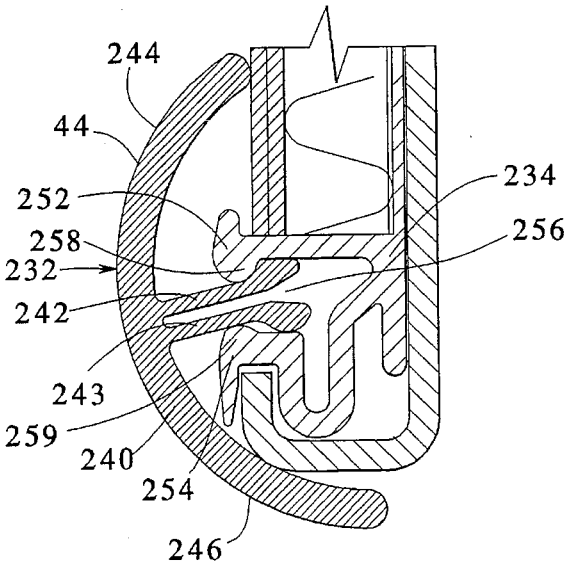

DISHWASHER FRONT PANEL RETAINER CHANNEL

BACKGROUND OF THE INVENTION

This invention generally relates to retaining devices. More particularly, this invention relates to an improved receiving channel for a snap-fit panel retainer.

An appliance generally has a visible external surface. Such a surface can consist of a decorative panel which can be painted or constructed of colored material for aesthetic purposes. For instance, a dishwasher, trash compactor, or other kitchen appliance can have a decorative front surface. The present invention is particularly suited for use on a dishwasher.

A front panel of an appliance can be interchangeable so that a user can change the decorative look of the appliance. For example, multiple panels of different colors can be provided with the appliance. A user can select and install a desired panel.

A replaceable front panel of an appliance or cabinet is generally fitted into a frame structure, where it is retained by a retaining device. However, known retaining devices can require the use of tools. Furthermore, known retaining devices can be difficult to use or understand.

U.S. Pat. No. 4,732,431 discloses a frame for interchangeable panels for a dishwasher. A retainer strip is held in place by a screw for securing a panel within a door frame. Alternatively, the retainer strip has resilient ramped legs which snap into holes in the frame for securing the panel in place. To remove the snap-fit retainer strip, the resilient ramped legs must be deflected clear of the hole.

U.S. Pat. No. 4,229,921 discloses a frame for a decorative appliance panel. The decorative panel frame is secured to the appliance door by a plurality of threaded screws.

U.S. Pat. No. 3,298,764 discloses a cabinet door with a removable mirrored panel. The mirror is retained in position by pieces that fit into channels and held therein by an adhesive.

U.S. Pat. No. 3,294,461 discloses a dishwasher having a front panel retained by strips held in place by screws.

U.S. Pat. No. 3,936,107 discloses an interchangeable door panel held in place by a retainer strip having tabs to fit in slots in a door frame.

U.S. Pat. No. 4,949,520 discloses edge retainer strips for a modular room panel structure.

Thus, the prior art shows a number of different structural arrangements for retaining interchangeable door panels in appliances. However, a need exists for a means of retaining interchangeable decorative appliance panels which is simple to use and requires no tools.

U.S. patent application Ser. No. 08/266,345 discloses a retainer for an appliance panel in which a resilient retainer strip fits into an extruded channel member by means of a snug fit so that the retainer strip can easily be removed and reinstalled without the use of tools. The channel member was disclosed as being held in place, preferably by using double-sided adhesive tape, although other arrangements such as screws, molded snaps and rivets are also disclosed.

SUMMARY OF THE INVENTION

The present invention provides an improved channel member, and means for mounting the channel member such that the channel member will be securely held in place relative to a frame and without the use of separate fasteners. The channel member of the invention also is better restrained against twisting or rolling around its major axis.

The extruded channel member has a channel portion designed to engage with a projection on the retainer so that the two parts snap together as disclosed in U.S. patent application Ser. No. 08/266,345. The channel portion is profiled to accommodate an upturned flange on the frame of the appliance. The upturned flange resists bending forces and helps to prevent the channel from being inadvertently removed from the frame in that a part of the channel portion is received and captured behind the flange. The channel portion, as mentioned, is profiled to avoid interference with the metal flange, and has a part which lies in front of the flange. The effective length of this part of the channel portion is increased over prior constructions which allows easier removal of the retainer strip from the channel due to increased flexure of the channel portion.

The channel member has also been modified to include a back portion which extends away from the channel portion. This back portion lies against the frame and is sandwiched between the frame and the panels and spacer. The stiffness of the spacer and panels reduces the tendency of the channel member to roll around its major axis. The back portion is captured at a distal end by one or more tabs which are formed as a cut-out from the frame. The tabs are originally formed so as to be bent away from the remainder of the frame, but are crimped back towards the frame once the channel member has been slid onto the frame. The tabs restrain the channel's horizontal and vertical movement relative to the frame.

Additional features and advantages of the present invention are described in, and will be apparent from, the detailed description of the presently preferred embodiments and from the drawings.

BRIEF DESCRIPTION OF THE DRAWINGS

FIG. 3 illustrates a sectional top view of a door assembly embodying features of the present invention.

FIG. 4 illustrates a sectional side view of a retainer clip and channel member structure of the present invention taken generally along line IV—IV of FIG. 2.

FIG. 5 illustrates a sectional side view of an alternative embodiment of a retainer clip and channel member structure of the present invention taken generally at the same place as FIG. 4.

FIG. 6 illustrates a sectional side view of another alternative embodiment of a retainer clip and channel member structure of the present invention taken generally at the same place as FIG. 4.

DETAILED DESCRIPTION OF THE PREFERRED EMBODIMENTS

In accordance with the invention described with reference to the accompanying figures wherein like numerals designate like parts, an appliance 10 is provided which has a front panel 12. The appliance 10 illustrated in FIG. 1 is a dishwasher, however, the present invention could be used with other appliances or other objects having a removable panel.

Figure 1:
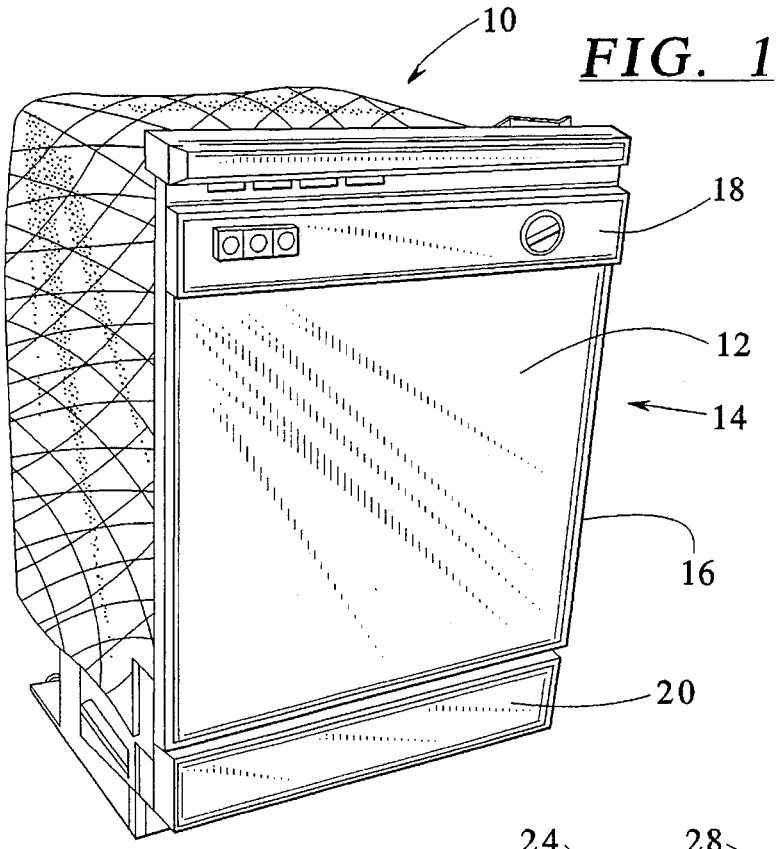
FIG. 1 illustrates a perspective view of a dishwasher which embodies the features of the present invention.

As illustrated in FIG. 1, the front panel 12 is disposed in a door 14 of the appliance 10. The door 14 has a frame 16 which generally surrounds the front panel 12. The dishwasher 10 shown in FIG. 1, has a control panel 18 positioned along the top of the door 14 and a lower access panel 20 positioned below the door 14.

In a domestic environment, a dishwasher 10 is typically installed in a kitchen cabinet structure (not shown) so that the front of the dishwasher 10 is exposed for access. Thus, the front panel 12 of the dishwasher 10 is visible in a kitchen. Therefore, the front panel 12 is preferably painted or constructed of a colored material. The front panel 12 can be removed and exchanged with another panel having a different color. Optionally, a front panel 12 can be provided having a different color on each side so that it can be turned around for changing the aesthetic appearance of the dishwasher 10.

Figure 2:
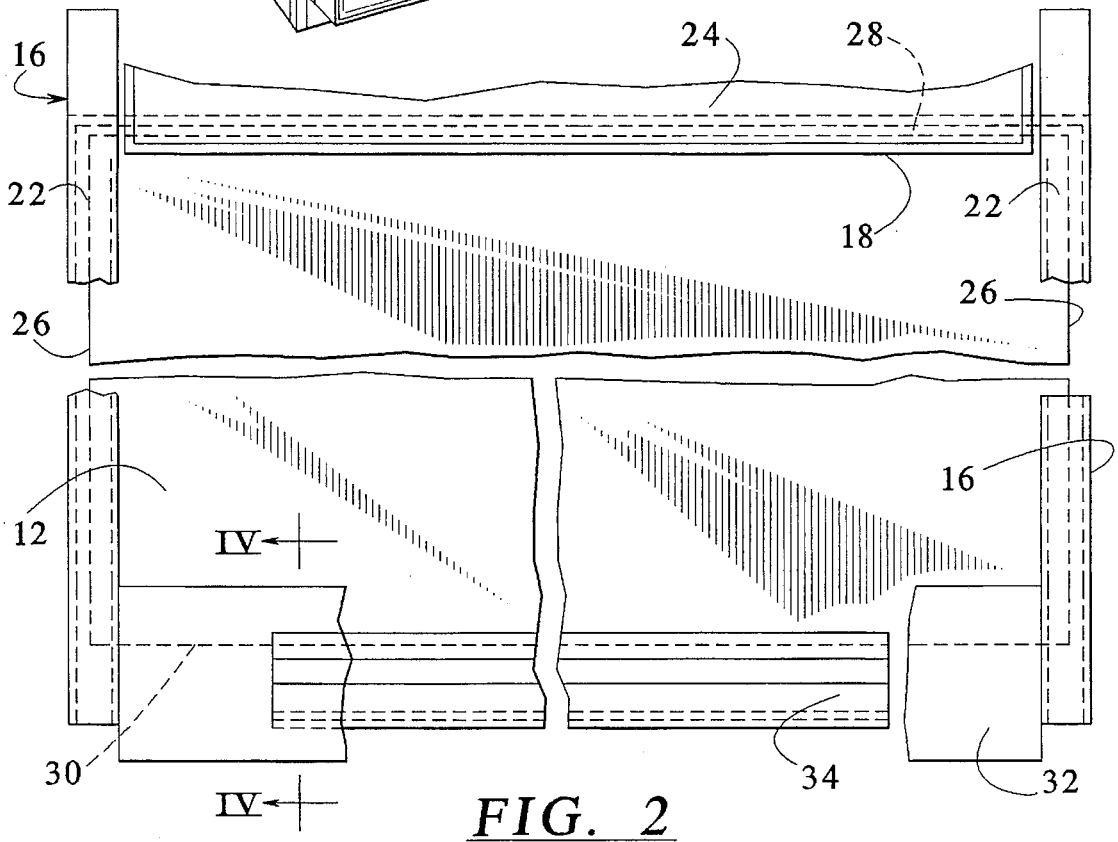
FIG. 2 illustrates a fragmentary front plan view of a door assembly having positions broken away to reveal features of the present invention.

Referring to FIG. 2, the retaining means of the present invention is illustrated. Two sides of the front panel 12 are received by the frame 16 into two vertical side grooves 22 and a third side is received in a horizontal top groove 24 in the control panel 18. The side grooves 22 receive side edges 26 of the front panel 12, and the top groove 24 receives a top edge 28 of the front panel 12. A bottom edge 30 of the front panel 12 is secured in position by a retainer strip 32, 132, 232.

The retainer strip 32, 132, 232 is an elongated, resilient component which can be extruded from a plastic material. The retainer strip 32, 132, 232 is held in position by an elongated channel member 34, 134, 234 which is secured to the bottom of the frame 16. The channel member 34, 134, 234 is preferably resilient and can be extruded from a plastic material in the form of an extruded strip. The retainer strip 32, 132, 232 is held firmly by the channel member 34, 134, 234 against the front panel 12 so that the retainer strip 32, 132, 232 is biased against the front panel 12, holding the front panel 12 in position. Preferably, the retainer strip 32, 132, 232 is slightly longer than the channel member 34, 134, 234.

FIG. 3 illustrates the shape of the frame 16 which has the side grooves 22 formed therein. Preferably, a corrugated spacer panel 36 is positioned behind the front panel 12. The edges of the corrugated spacer panel 36 also extend into the side grooves 22 and the top groove 24.

An embodiment of the retainer strip 32 and channel member 34 are illustrated in greater detail in FIG. 4. The elongated channel member 34 is attached to the frame 16 and extends horizontally across the bottom of the door 14. The channel member 34 has a channel portion 1036 to receive the retainer strip 32 as discussed in greater detail below. The channel member 34 also has a back portion 1038 which extends away from the channel portion 1036. The back portion lies against the frame 16 and is sandwiched between the frame 16 and the spacer 36 and panel 12.

One or more, and preferably three, tabs 1040 are formed from the frame 16 in the form of punch outs having one end 1042 still connected to the frame 16. A free end 1044 of each tab 1040 is originally spaced away from the frame 16 in the direction of the spacer 36. When the channel member 34 is assembled to the frame 16, such as by sliding the channel member relative to the frame 16, the tabs 1040 are crimped (as shown in dashed lines) against a distal end 1046 of the back portion 1038 to sandwich and lock the distal end 1046 between the tabs 1040 and the frame 16. The tabs 1040 will restrain the channel member's horizontal and vertical movement relative to the frame 16.

As shown, if the frame 16 is provided with a step or an offset 1050, for strengthening or other purposes, the back portion 1038 will preferably have a corresponding a step or offset 1052 so that the channel member 34 will lie against the frame 16 at the channel portion 1036 and at the distal end 1046 of the back portion 1038.

The frame 16 is provided with a lip 1054 extending approximately perpendicular to a first portion **16*a* of the frame 16 engaged by the back portion 1038. The lip 1054 is provided with a flange 1056 extending approximately perpendicular to the lip 1054 and parallel to and in the same direction as the portion of the frame 16 engaged by the back portion. The channel portion 1036 of the channel member 34 is captured between the flange 1056 and the frame 16 and preferably also engages the lip 1054** connecting the flange and frame.

The channel portion 1036 is profiled to avoid interference with the flange 1056 after the channel member 34 is assembled to the frame 16.

The retainer strip 32 is configured to snap-fit into the channel member 34. The retainer strip 32 has an elongated resilient member 40. In the preferred embodiment, a T-shaped projection 42 extends generally perpendicularly from the elongated resilient member 40 and preferably extends the length of the resilient member 40. Also, the elongated resilient member 40 has an upper half 44 which is prone toward the direction of the front panel 12. The upper half 44 can be angled, as illustrated in FIG. 4 or it could be curved on an arc, as in FIG. 6. The T-shaped projection 42 is shaped to be received and held within the channel member 34 so that the upper half 44 is held in biased contact against the panel 12, slightly deflecting the upper half 44.

Preferably, the retainer strip 32 is symmetrical on either side of the T-shaped projection 42. This prevents a user from installing the retainer strip 32 upside-down. For this reason, a lower half 46 is preferably provided which is symmetrical to the upper half 44.

In the preferred embodiment, the T-shaped projection 42 has an upper ramped edge 48 and a lower ramped edge 50. The upper ramped edge 48 and lower ramped edge 50 are preferably symmetrical to each other. Also in the preferred embodiment, the channel member 34 has a resilient upper leg or ledge 52 which extends in a generally forward direction. Also, the channel member 34 has a lower resilient leg or ledge 54 that extends generally in a forward direction. Between the upper ledge 52 and the lower ledge 54, a channel interior 56 is defined. The channel member 34 and retainer strip 32 are configured so that the channel member 34 can cooperatively receive the T-shaped projection 42 between the upper ledge 52 and the lower ledge 54.

The upper ledge 52 has a detent in the form of a lip 58 disposed along the upper ledge 52, extending downwardly. The lower ledge 54 preferably extends out of the channel interior 56, curving down and away, with a free leg 1058 and a connecting leg 1060 forming a hollow area 60 within which is received the flange 1056. The connecting leg 1060 is formed with a hairpin bend 1061 to increase the flexibility and resiliency of this leg. The length of the leg and the bend increase the flexibility over prior constructions making it easier to insert and remove the T-shaped projection 42 of the retainer strip 32 relative to the channel member 34. This prevents an excessive pulling force from being applied to the channel member 34 when the retainer strip 32 is removed from the channel member, in turn assuring that the channel member will not be inadvertently removed from the frame.

The T-shaped projection 42 is insertable between the upper ledge 52 and the lower ledge 54. The upper ledge 52 and lower ledge 54 can be deflected, allowing the T-shaped projection 42 to slide into the channel interior 56. The lip 58 snaps down over the upper ramped edge 48 when the T-shaped projection 42 is inserted into the channel interior 56. Similarly, the lower ramped edge 50 contacts the lower ledge 54 at an angle which biases the T-shaped projection 42 into the channel interior 56 with a sort of camming action.

Preferably, a ridge 62 can be provided which extends upwardly from the upper ledge 52. The ridge 62 assists a user by positioning the bottom edge 30 of the panel 12 before the retainer strip 32 has been inserted into the channel member 34.

FIG. 5 illustrates an alternative embodiment of the present invention. In this embodiment, a retainer strip 132 has two projections, an upper projection 142 and a lower projection 143 which extend from a resilient member 140. A channel member 134 has an upper ledge 152 and a lower ledge 154. Between the upper ledge 152 and the lower ledge 154, a channel interior 156 is defined. The upper ledge 152 has a first lip 158 that extends downward into the channel interior. In this embodiment, the lower ledge 154 has a second lip 159 that extends upwardly into the channel interior 156. The first lip 158 and second lip 159 fit over the upper projection 142 and lower projection 143, respectively, to secure the retainer strip 132 to the channel member 134.

The channel member 134 is shaped to receive the upper projection 142 and lower projection 143 in a snap-fit manner. The upper projection 142 and lower projection 143 fit into the channel interior 156, between the upper ledge 152 and the lower ledge 154. The upper projection 142 and lower projection 143 are biased away from one another when in the channel interior 156. In the embodiment of FIG. 5, the retainer strip 132 is not symmetrical on either side of its two projections 142, 143. The resilient member 140 has an upper half 144 which is held in biased contact against the front panel 12. However, the resilient member 140 has a lower half 146 that is short and wraps down around the tip of the lower ledge 154.

FIG. 6 illustrates another alternative embodiment which provides a retainer strip 232 that is symmetrical on either side of an upper projection 242 and a lower projection 243. The upper projection 242 and lower projection 243 extend generally perpendicularly from a resilient member 240. In this embodiment, the elongated resilient member 240 has an upper half 244 and a lower half 246 which are curved in a substantially arcuate fashion. However, the resilient member 240 could have an angled shape, as described above and as shown in FIG. 4.

The retainer strip 232 fits into a channel member 234. The channel member 234 has an upper ledge 252 and a lower ledge 254 which define a channel interior 256. The upper ledge 252 has a first lip 258 and the lower ledge 254 has a second lip 259. The first lip 258 and second lip 259 fit over the upper projection 242 and lower projection 243, respectively, to secure the retainer strip 232 to the channel member 234.

In the embodiments illustrated in FIGS. 5 and 6, it is important that the upper projections 142, 242 and lower projections 143,243 are resiliently deflectable. While it is preferable that the upper ledge 152, 252 and lower ledge 154, 254 also be resilient and deflectable in these embodiments, the upper ledge 152, 252 and lower ledge 154, 254 can be somewhat rigid because of the deflection of the two projections. On the other hand, the upper ledge 52 and lower ledge 54 in the embodiment illustrated in FIG. 4 must be resilient and deflectable in order to receive the single T-shaped projection 42.

When a user installs a front panel 12, the front panel 12 is bowed vertically so that the side edges 26 can be positioned in the vertical side grooves 22. The front panel 12 is then slid upward so that the top edge 28 of the front panel 12 is received into the horizontal top groove 24 disposed in the control panel 18. The bottom edge 30 of the front panel 12 can rest on the upper ledge 52, 152, 252 so that it is positioned behind the ridge 62. The user can then take his hands off of the front panel 12 while inserting the retainer strip 32, 132, 232. The user presses the retainer strip 32, 132, 232 so that the projection 42 or projections 142, 143, 242, 243 are received into the channel interior 56, 156, 256 where the projection 42 or projections 142, 143, 242, 243 are held by a snap-fit. The upper half 44, 144, 244 of the resilient member 40, 140, 240 is held in contact against the front panel 12, holding the front panel 12 in position within the frame 16 and against the corrugated spacer panel 36.

The retainer strip 32, 132, 232 can be removed by pulling on an end of the retainer strip, peeling the retainer strip 32, 132, 232 away from the channel member 34, 134, 234. Because the retainer strip 32, 132, 232 is preferably slightly longer than the channel member 34, 134, 234 as shown in FIG. 2, a user can grip an end of the retainer strip 32, 132, 232 easily without the use of any tools.

When the retainer strip 32 is peeled from the channel member 34, in the embodiment shown in FIG. 4, the resilient upper ledge 52 and resilient lower ledge 54 deflect away from each other. This allows the upper ramped edge 48 to clear the lip 58 and allowing the lower ramped edge 50 to clear the lower ledge 54, so that the T-shaped projection 42 can be pulled from the channel interior 56. The channel member 34 will be securely retained against the frame 16 by the crimped tabs 1040 and the flange 1056 while the T-shaped projection 42 is being removed from channel interior 56. In the embodiments illustrated in FIGS. 5 and 6, the upper projection 142, 242 and lower projection 143, 243 can be deflected toward one another so that they can be pulled from the channel interior 56.

Once the retainer strip 32, 132, 232 has been removed, a user can remove the front panel 12 by sliding the front panel 12 upward so that the bottom edge 30 of the front panel 12 can be pulled clear of the upwardly extending ridge 62. The front panel 12 is then slid downward until the top edge 28 is clear of the horizontal top groove 24 disposed under the control panel 18. The front panel 12 can then be bowed so that its side edges 26 can be removed from the vertical side grooves 22.

While the invention has been described in an arrangement for retaining the bottom edge of a panel 12, it should be understood to those skilled in the art that the retainer strip 32, 132, 232 and the channel member 34 could be used to retain a side or top edge as well.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A combination of a channel member, a frame of an appliance and a retaining strip, wherein said channel member is configured to be held on said frame, and wherein said frame includes a lip perpendicular to a first portion of said frame with a flange extending perpendicular to said lip parallel to and in a direction of said first portion of said frame, and at least one tab projecting out of said first portion of said frame, said channel member being configured to receive said retaining strip having a projecting portion, said channel member comprising:

a channel portion and a back portion, said back portion extending between said lip and said tab and having a portion retainingly held by said tab;

said channel portion comprising a first resilient leg and a second resilient leg, said first and second legs being spaced apart to form a channel for receiving said projecting portion of said retaining strip, at least one of said first and second legs having a detent formed thereon to retainingly engage said projection, said second leg being configured to at least partially be received in an area defined by said first portion of said frame, said lip and said flange and to avoid engaging interference with said flange.

2. A channel member according to claim 1, wherein said first and second legs project from said back portion.

3. A channel member according to claim 1, comprising an extruded strip with said back portion and said channel portion integrally formed.

4. A channel member according to claim 1, wherein said back portion is configured to lie against and conform to a profile of the frame which it overlies.

5. A channel member according to claim 1, wherein said detent is formed on said first leg.

6. A channel member according to claim 1, wherein at least one of said legs extends from said back portion and includes a hairpin bend to increase a flexibility of said leg.

7. An appliance comprising:

a frame having grooves;

a removable panel having edges;

a channel member secured to a first portion of said frame disposed adjacent to said panel;

said frame including a lip perpendicular to said first portion of the frame with a flange extending perpendicular to said lip parallel to and in the direction of said first portion of said frame, and at least one tab projecting out of said first portion of said frame, said channel member having a channel portion and a back portion, said back portion extending between the lip and the tab and having a portion retainingly held by the tab;

an elongated retainer strip having at least one projection that extends substantially a length of said retainer strip;

wherein said at least one projection retainingly fits into said channel member so that said retainer strip can retain an edge of said panel and a remainder of said edges are retained in said grooves.

8. An appliance according to claim 7, wherein said first portion of said frame includes a step and said back portion of said channel member also includes a step so that said back portion will engage against said first portion of said frame along substantially the entire height of said back portion.

9. An appliance according to claim 7, wherein said channel portion comprises a first resilient leg and a second resilient leg, said first and second legs being spaced apart to form a channel for receiving said projecting portion of said retaining strip, at least one of said first and second legs having a detent formed thereon to retainingly engage said projection.

10. An appliance according to claim 9, wherein said second leg is configured to at least partially be received in an area defined by the first portion of the frame, the lip and the flange and to avoid engaging interference with the flange.

11. A channel member according to claim 9, wherein at least one of said legs extends from said back portion and includes a hairpin bend to increase a flexibility of said leg.

12. An appliance according to claim 7, wherein said channel member is positioned behind said panel.

13. An appliance according to claim 7, wherein said back portion is sandwiched between said panel and said first portion of said frame.

* * * * *